US006659160B1

(12) United States Patent
Dague, Jr.

(10) Patent No.: US 6,659,160 B1
(45) Date of Patent: Dec. 9, 2003

(54) REVERSE BREAK STAMP HOOK ASSEMBLY

(75) Inventor: Robert Dague, Jr., DeGraff, OH (US)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/201,837

(22) Filed: Jul. 24, 2002

(51) Int. Cl.[7] ..... B22D 31/00
(52) U.S. Cl. ..... 164/70.1; 164/264; 425/806
(58) Field of Search ..... 164/70.1, 262, 164/264, 265; 264/161; 425/806; 225/1, 93, 103

(56) References Cited

U.S. PATENT DOCUMENTS 3,672,437 A 6/1972 Bennett
3,772,946 A 11/1973 Sarra
4,607,680 A 8/1986 Mills et al.
4,799,534 A 1/1989 Ueno et al.
5,664,471 A * 9/1997 Dundas ..... 83/24
5,839,497 A 11/1998 Fujino et al.

* cited by examiner

*Primary Examiner*—Kuang Y. Lin
(74) *Attorney, Agent, or Firm*—Rankin, Hill, Porter & Clark LLP; Alan T. McDonald; Vincent Ciamacco

(57) ABSTRACT

A reverse break stamp hook assembly and method for breaking a biscuit from a casting. The reverse break stamp hook assembly is mounted to an upper trim die of conventional stamping equipment, and includes a leg that hangs from a pivot attached to a mounting bracket and a counterweight arm that extends from the pivot. The hook includes an angled front portion and a catch portion. As the upper trim die moves toward a lower trim die during the downstroke, the angled front portion of the hook contacts an edge of the biscuit. The contact between the edge of the biscuit and the angled front portion of the hook causes the hook to pivot away from the biscuit until the catch portion passes below the biscuit. The counterweight causes the hook to pivot back toward the biscuit, positioning the catch portion under the biscuit. During the upstroke, the catch portion engages the bottom side of the biscuit and causes the biscuit to break from the part as the upper trim die is raised. The biscuit breaks clean and does not leave a high gate.

17 Claims, 3 Drawing Sheets

REVERSE BREAK STAMP HOOK ASSEMBLY

BACKGROUND OF THE INVENTION

1. Field of the Invention

The present invention relates to a reverse break stamp hook assembly for use in breaking a biscuit from a casting and a method of breaking a biscuit from a casting using a reverse break stamp hook assembly.

2. Description of Related Art

The die casting process is used to produce accurately dimensioned, sharply defined, smooth and/or textured-surface metal parts. In the die casting process, molten metal such as, for example, aluminum and alloys of aluminum, is forced under high pressure into a cavity between two die halves. The injected molten metal quickly solidifies in the die cavity, then the two die halves are drawn apart and the casting is ejected.

The ejected casting typically includes extraneous material (e.g., flash, which is a thin web or fin of metal on a casting that occurs at die partings, vents and around moveable cores) that must be removed from the casting in order to obtain an acceptable part. In addition, castings formed using a cold chamber die casting machine will have a gate or biscuit, which is the excess of ladled metal remaining in the shot sleeve, that must be removed. The extraneous material and biscuit are typically removed in a stamping operation using a pair of trim dies and a die casting biscuit breaking apparatus. The trim dies include cutting/trimming surfaces as well as punches or other desired tooling.

FIGS. 1A and 1B show a schematic front view of a conventional die casting biscuit breaking apparatus 10. The apparatus 10 consists of an upper trim die holder 18, an upper trim die 20, a lower trim die holder 28, and a lower trim die 30. A part 40 (or several parts) is placed between the dies 20, 30, typically on the lower trim die 30. The part 40 will typically include extraneous material (e.g., flash) that needs to be trimmed, surfaces to be punched, as well as a gate or biscuit 50 that needs to be removed. As shown in FIG. 1 B, the upper trim die holder 18 is moved downwardly to press the upper trim die 20 against the part 40 on the lower trim die 30 and thereby trim away the extraneous material from the part 40. Conventionally, the upper trim die holder 18 also includes a stamp cutter 60 that presses downwardly against the biscuit 50 or gate to break the biscuit from the part 40.

One of the problems with a conventional die casting biscuit breaking apparatus 10 is that the biscuits 50 tend to break off a distance from the part 40, leaving a portion of biscuit material, sometimes referred to as a "high gate"70, remaining on the part 40. These high gates 70 must be removed by hand, typically using angle grinders. This results in additional processing time and effort. On occasion, a high gate 70 will not be noticed upon inspection or will be improperly removed by hand. An overlooked high gate 70 can cause damage to tooling in downstream processes, resulting in machine down time and additional losses in production time due to the need to hand sort parts to find the missed high gates 70.

SUMMARY OF THE INVENTION

The present invention provides a reverse break stamp hook assembly for use in breaking a biscuit from a casting, and a method of breaking a biscuit from a casting using the reverse break stamp hook assembly. Surprisingly, the reverse break stamp hook assembly and method according to the invention facilitate the removal of biscuits without creating a high gate. Moreover, the reverse break stamp hook assembly may be used with conventional stamping machines without modifying the operating sequence of the machine.

In accordance with the present invention, a reverse break stamp hook assembly is mounted in place of a stamp cutter on conventional stamping equipment. The reverse break stamp hook assembly includes a hook and a mounting bracket. The hook, which includes a downwardly extending leg and a counterweight arm, hangs from a pivot attached to the mounting bracket. A distal end of the hook leg has an angled front portion and a catch portion.

In further accordance with the present invention, as the upper trim die of the stamping equipment moves toward the lower trim die during the downstroke, the angled front portion of the hook contacts and slides over an edge of a biscuit, causing the hook to pivot away from the biscuit until the catch portion passes below the biscuit. The counterweight arm, which is on the opposite side of the pivot, causes the hook to pivot back toward the biscuit, positioning the catch portion under the biscuit. During the upstroke, the catch portion engages the bottom side of the biscuit and pulls the biscuit upwardly away from the part, causing the biscuit to break from the part as the upper trim die is raised. The biscuit breaks cleanly, and does not leave a high gate requiring further hand grinding. Accordingly, a rough cleaned and trimmed part results from use of the trim dies incorporating the reverse break stamp hook assembly of the present invention.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1A:
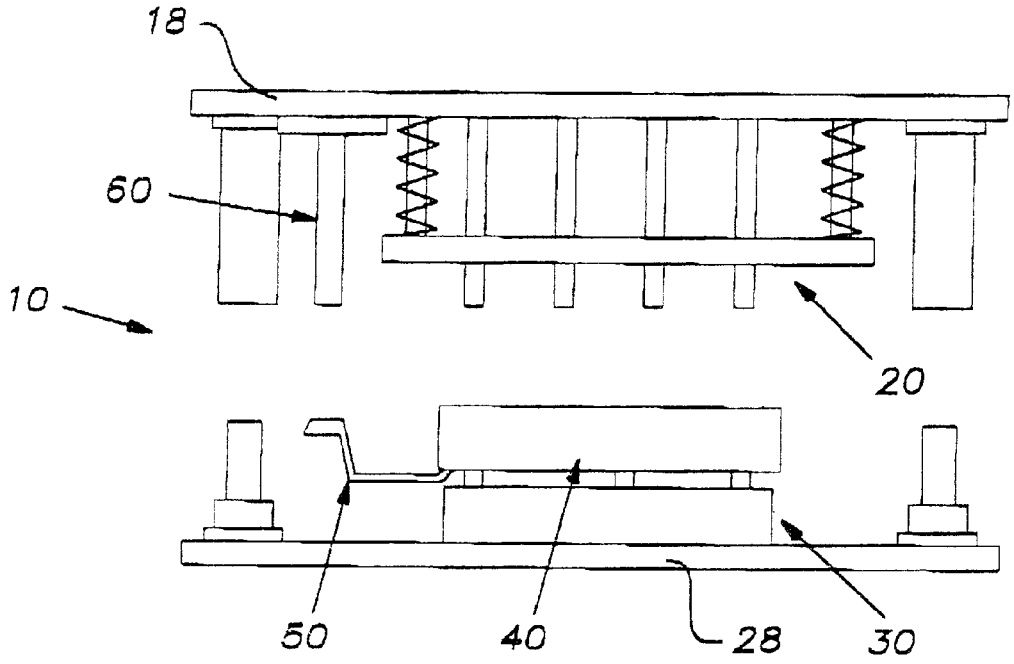
FIG. 1A PRIOR ART
FIG. 1A is a schematic front view of a prior art die casting biscuit breaking apparatus prior to the stamping downstroke.
Figure 1B:
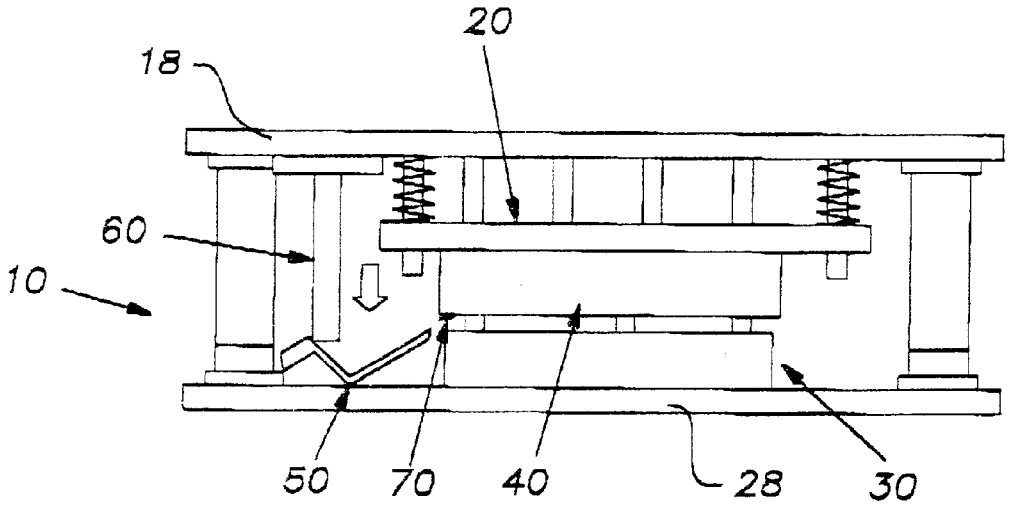
FIG. 1B PRIOR ART
FIG. 1B is a schematic front view of the prior art die casting biscuit breaking apparatus shown in FIG. 1A after the stamping downstroke.
Figure 2:
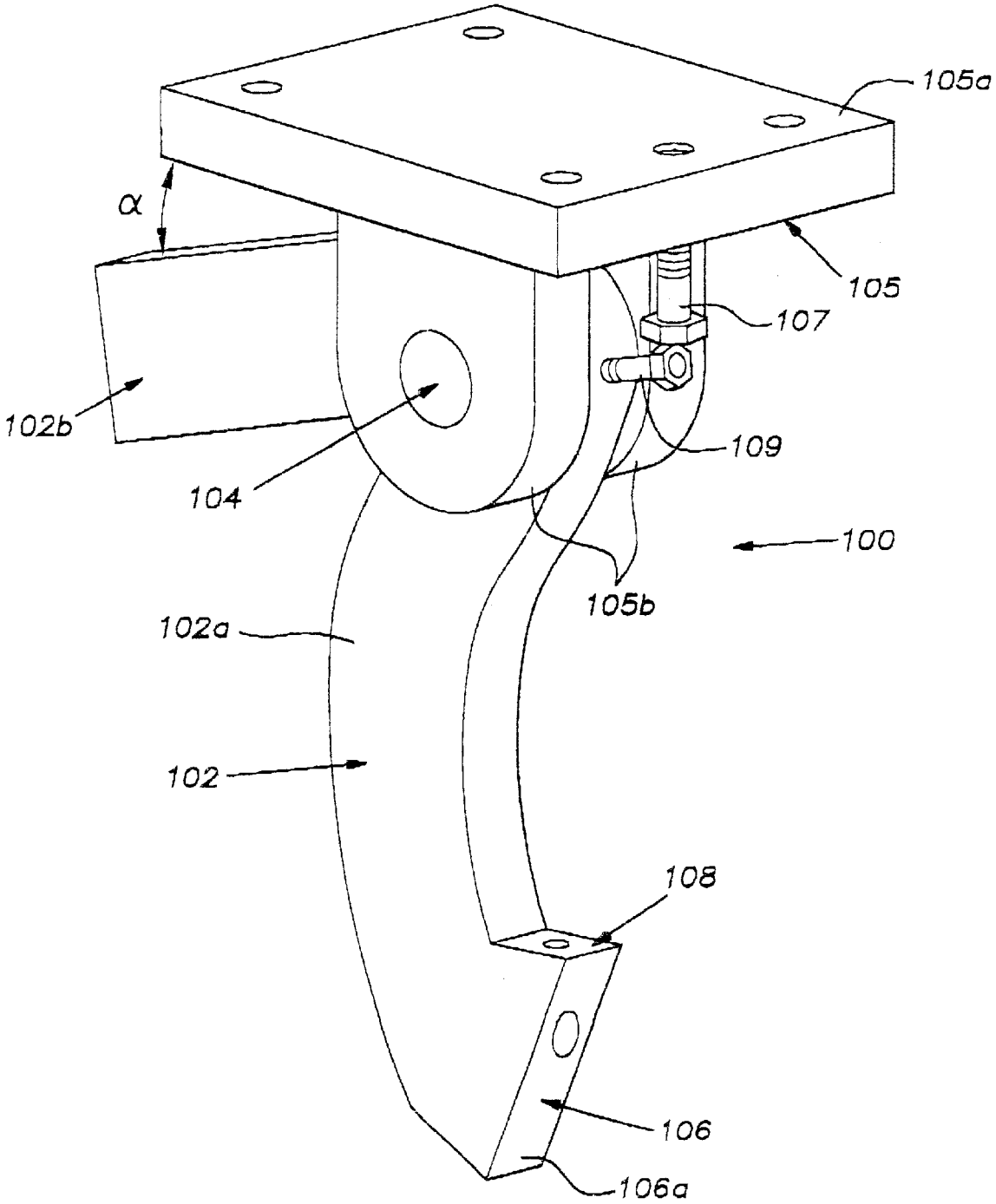
FIG. 2 is a perspective view of a preferred embodiment of a reverse break stamp hook assembly according to the invention.

With reference to FIG. 2, a reverse break stamp hook assembly 100 according to the invention comprises a hook 102 and a mounting bracket 105. The hook 102 includes a pin or pivot 104 by mans of which the hook 102 is supported and pivotally secured to the mounting bracket 105. The hook 102 comprises a downwardly extending leg 102*a* and a counterweight arm 102*b*. The leg 102*a* has a distal end with an angled front portion 106 and a catch portion 108. The counterweight arm 102*b* extends away from the pivot 104 in a direction opposite the direction the catch portion 108 faces. Mechanical stops 107, 109 provided by the hook 102 and mounting bracket 105, respectively, cooperate to limit the hook's pivotal movement toward the biscuit, and will be described more fully hereinafter. The counterweight arm 102*b* balances the leg 102*a* such that the leg 102*a* is urged into a position in which the stops 107, 109 are engaged with one another and the leg 102*a* hangs from the pivot 104, preferably with a lower edge 106*a* of the angled front portion 106 disposed essentially directly below the pivot axis of the pivot 104. As such, the counterweight arm 102*b* and stops 107, 109 cooperate to define and maintain the hook 102 in a desired at-rest and operating position wherein the catch portion 108 is generally horizontally oriented and positioned to engage a downwardly facing surface of the biscuit 128 in face-to-face contact.

In the preferred and illustrated embodiment, the mounting bracket 105 includes a solid and planar mounting plate 105a from which a pair of spaced-apart mounting arms 105*b* downwardly extend. The mounting plate 105*a* is secured to an upper trim die holder 121, described hereinafter. The mounting arms 105*b* define a pair of aligned openings that cooperate to receive the pivot 104. Each of the mounting arms 105*b* rotatably supports an end of the pivot 104, and may be either one-piece (FIG. 2) or two-piece construction (i.e., split mounting arm). The mounting arms 105*b* may optionally hold a bearing to facilitate repair and maintenance of the rotary connection between the mounting arms 105*b* and the pivot 104 of the hook 102.

As noted hereinbefore, the hook 102 is generally shaped as an upside-down L such that the counterweight arm 102*b* extends at a 90° angle or less relative to the leg 102*a*. The counterweight arm 102*b* is integrally formed with the leg 102*a*, preferably as one piece, and a pin receiving opening (not shown) is defined generally at the intersection of the arm 102*b* and leg 102*a*. The pivot 104 is received in the pin receiving opening and extends therefrom so as to fit into the openings in the mounting arms 105*b*. The pivot 104 is affixed to the hook 102 so as to define a unitary structure that is adapted to pivot or rotate as one piece relative to the mounting arms 105*b*. As shown in the drawing figures and described more fully hereinafter, the counterweight arm 102*b* is normally at an acute angle $\alpha$ to the mounting plate 105*a*, and is adapted to move or rotate upwardly toward the mounting plate 105*a* as the leg 102 is pivoted outwardly from its at-rest position.

Figure 3A:
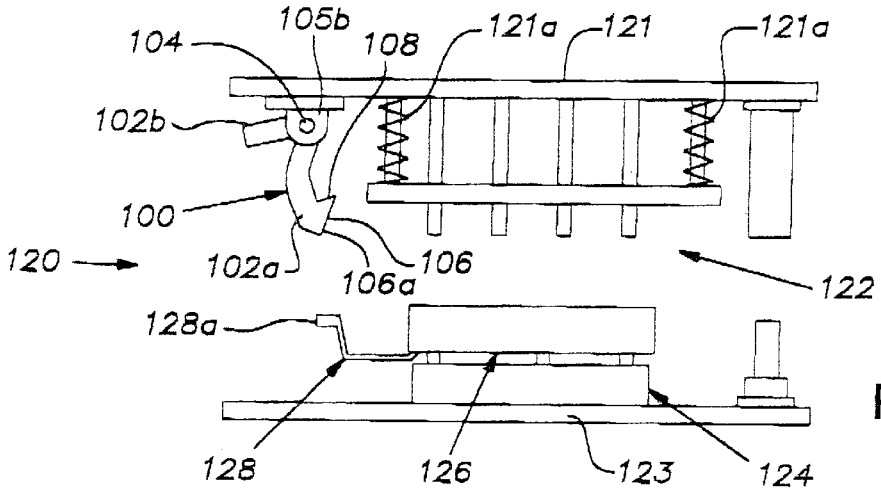
FIG. 3A is a schematic front view of a die casting biscuit breaking apparatus according to the present invention prior to the stamping downstroke.
Figure 3B:
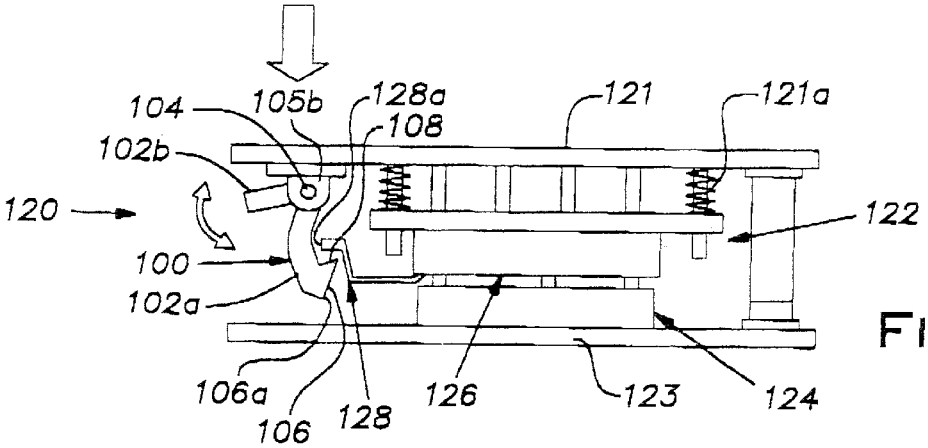
FIG. 3B is a schematic front view of the die casting biscuit breaking apparatus shown in FIG. 3A at the bottom of the stamping downstroke.
Figure 3C:
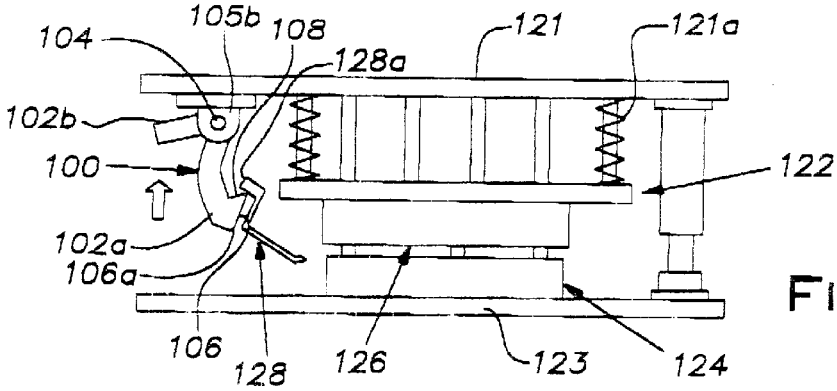
FIG. 3C is a schematic front view of the die casting biscuit breaking apparatus shown in FIG. 3A at the beginning of the stamping upstroke.

FIGS. 3A–3C illustrate use of the reverse break stamp hook assembly 100 in conjunction with a biscuit breaking apparatus 120. It is noted that the stops 107, 109 illustrated in FIG. 2, although present in the apparatus, are not shown in FIGS. 3A–3C for purposes of clarity.

FIG. 3A shows a schematic front view of a modified die casting biscuit breaking apparatus 120, which incorporates the reverse break stamp hook assembly 100 of the present invention, described hereinbefore. The apparatus 120 consists of an upper trim die holder 121, an upper trim die 122, a lower trim die holder 123, and a lower trim die 124. A part 126 (or several parts) is placed between the dies 122, 124, typically on the lower trim die 124. The part 126 will typically include extraneous material (e.g., flash) that needs to be trimmed, holes to be punched, as well as a gate or biscuit 128 that needs to be removed. The reverse break stamp hook assembly 100 is mounted to the upper trim die holder 121 in place of a conventional stamp cutter. Conventionally, flash, biscuits, and other material is trimmed, broken, or cut from the parts being worked on during the downstroke. In the present invention, described hereinafter, at least the biscuit 128 is removed or broken-off during the upstroke.

In FIG. 3A, the upper trim die 122 and lower trim die 124 of the modified die casting biscuit breaking apparatus 120 are separated from each other. In FIG. 3B, the upper trim die holder 121 has been moved downwardly to press the upper trim die 122, part 126, and lower trim die 124 together. The upper trim die holder 121 conventionally includes a resilient mount (i.e., die springs 121*a*) for the upper trim die 122 that is compressed during the downstroke as the upper trim die 122 engages the part 126/lower trim die 124 and is de-compressed during the upstroke as the upper die holder 121 is moved away from the lower die holder 123.

As will be appreciated by those skilled in the art, there is a period of lost motion at the end of the downstroke and the beginning of the upstroke in which the upper die holder 121 moves relative to the upper trim die 122, lower trim die 124, and lower trim die holder 123 while the upper trim die 122 is stationary relative to the lower trim die 124 and lower trim die holder 123. The present invention takes advantage of this period of lost motion to properly locate and implement the reverse break stamp hook assembly 100 relative to the biscuit 128, described hereinafter.

Toward the end of the downstroke, the part 126 is sandwiched between the upper trim die 122 and the lower trim die 124, the upper trim die holder 121 is moving toward the lower trim die holder 123, the die springs 121*a* are being compressed, and the angled front portion 106 of the hook 102 contacts an edge 128*a* of the biscuit 128. The contact between the biscuit edge 128a and the angled front portion 106 of the hook 102, together with continued downward motion of the upper trim die holder 121 and reverse break stamp hook assembly 100, causes the hook 102 to rotate or pivot away from the biscuit 128. As viewed in FIGS. 3A–3C, the hook 102 rotates in a clockwise direction. The angled front portion 106 of the hook 102 slides along the edge 128*a* of the biscuit 128, without breaking it down, until the catch portion 108 passes below the biscuit 128. When the catch portion 108 passes below the biscuit 128, the hook 102 pivots or rotates in the counter-clockwise direction back toward the at-rest position in which the stops 107,109 engage one another.

In other words, after the catch portion 108 of the hook leg 102*a* passes below the edge 128*a* of the biscuit 128, the counterweight arm 102*b* on the opposite side of the pivot 104 causes the hook 102 to rotate back toward the biscuit 128, positioning the catch portion 108 under the biscuit 128, as shown in FIG. 3B. Rotation of the hook 102 in the clockwise direction is limited to the angle a (by possible engagement of the arm with the plate), while the return rotation or pivot in the counter-clockwise direction is limited by engagement of the stops 107, 109. Preferably, when the stops 107, 109 are in engagement with one another the catch portion 108 of the hook 102 is directly under the pivot axis of the pivot 104 and thereby prevents the catch portion 108 from slipping off of the biscuit 128 during the upstroke.

The catch portion 108 passes beneath the biscuit 128 just prior to the upper trim die holder 121 reaching the bottom position of its downstroke (i.e., wherein the die springs 121*a* have been fully compressed), so that there is minimal clearance between the catch portion and the biscuit 128. In tests conducted by the inventors, the spacing between the catch portion and the biscuit is preferably between about 10–20 mm. Accordingly, it will be appreciated that the spacing between the biscuit 128 and the hook catch portion 108 is exaggerated in FIG. 3B for purposes of clarity.

At the beginning of the upstroke, which is shown in FIG. 3C, the upper trim die holder 121 initially moves upwardly and the springs 121*a* decompress while the upper trim die 122 remains stationary. During this initial period the force of the springs 121*a* holds the upper trim die 122 stationary while the hook 102 moves upwardly relative to the upper trim die 122, the catch portion 108 engages the bottom side of the biscuit 128, and applies sufficient force to break the biscuit 128 from the part 126. It has been found that using the present invention reliably breaks the biscuit 128 cleanly from the part 126, and does not leave a high gate condition.

Almost immediately after breaking the biscuit, continued upward movement of the upper trim die holder 121 causes the springs 121*a* to completely decompress and, as the upper die holder 121 moves further away form the lower die holder 123, the upper trim die 122 moves with the upper die holder 121 away from the lower trim die 124. Because the reverse break stamp hook assembly 100 according to the invention does not create high gates, very little if any hand trimming is needed and the resulting trimmed and rough cleaned or finished part is immediately available for further processing. Accordingly, the present invention reduces production time and manual inspection and hand grinding, and protects downstream tooling from damage.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A reverse break stamp hook assembly for use in breaking a biscuit from a die cast part, comprising:

a mounting bracket for securing said reverse break stamp hook assembly to one of a pair of dies;

a hook that is pivotally secured to said mounting bracket, said hook having a distal end including a catch portion, said distal end being adapted to move downwardly and pivotally past said biscuit as said hook is moved toward said die cast part, said catch portion being adapted to engage the biscuit and break said biscuit from said die cast part as said hook is moved away from said die cast part.

2. The reverse break stamp hook assembly according to claim 1, wherein said hook further comprises a counterweight arm and a downwardly extending leg, said distal end being provided by said leg.

3. The reverse break stamp hook assembly according to claim 2, wherein said leg distal end includes an angled portion, said angled portion being adapted to engage and slide over said biscuit during movement of said hook toward said die cast part, causing said hook to pivot away from said biscuit and thereby allowing said catch portion to pass beneath said biscuit.

4. The reverse break stamp hook assembly according to claim 3, wherein the counterweight arm extends away from said leg in a direction generally opposite to a direction of said catch portion.

5. The reverse break stamp hook assembly according to claim 4, wherein a pivot pin secures the hook to the mounting bracket.

6. The reverse break stamp hook assembly according to claim 5, wherein said mounting bracket has a first stop and said hook has a second stop, said first and second stops being engaged with one another when said hook is in an at rest position.

7. The reverse break stamp hook assembly according to claim 1, wherein the mounting bracket is attached to an upper trim die of a die stamping machine.

8. A die stamping machine that is adapted to break a biscuit from a die cast part, said machine comprising:

an upper trim die;

a lower trim die that receives said die cast part to be trimmed;

a hook that is pivotally secured to said upper trim die, said hook having a distal end including a catch portion, said hook reciprocally pivoting as said distal end is moved downwardly past said biscuit during movement of said upper trim die toward said lower trim die so as to place said catch portion relatively beneath said biscuit, said catch portion being adapted to engage and break said biscuit from said die cast part as said hook is moved away from said lower trim die.

9. The die stamping machine according to claim 8, wherein said hook further comprises a counterweight arm and a downwardly extending leg, said distal end being provided by said leg.

10. The die stamping machine according to claim 9,.wherein said leg distal end includes an angled portion, said angled portion being adapted to engage and slide over said biscuit during movement of said hook toward said die cast part, causing said hook to pivot away from said biscuit and thereby allowing said catch portion to pass beneath said biscuit.

11. The die stamping machine according to claim 10, wherein the counterweight arm extends away from said leg in a direction generally opposite to a direction of said catch portion.

12. The die stamping machine according to claim 11, wherein a pivot pin secures the hook to the mounting bracket, and wherein said counterweight arm has a mass that is sufficient to cause the hook to hang from the pivot pin such that a lower edge of the angled portion is disposed generally directly below an axis of the pivot pin.

13. The die stamping machine according to claim 12, wherein said hook is secured to said upper trim die by a mounting bracket, said mounting bracket including a first stop and said hook including a second stop, said first and second stops being engaged with one another when said hook is in an at rest position.

14. A method of breaking a biscuit from a die cast part comprising:

placing the die cast part between an upper trim die and a lower trim die, the upper trim die being provided with a reverse break stamp hook assembly, the reverse break stamp hook assembly comprising a hook that is pivotally secured to the upper trim die, the hook having a catch portion and being biased toward a position wherein the catch portion is normal to a direction of movement of the upper trim die;

moving the upper trim die toward the lower trim die and thereby moving the reverse break stamp hook assembly toward the lower trim die;

positioning the catch portion below the biscuit; and reversing movement of the upper trim die relative to the lower trim die so as to move the reverse break stamp hook assembly away from the lower trim die;

engaging the biscuit with the catch portion; and, moving said catch portion away from said die cast part to break said biscuit off the die cast part.

15. The method of breaking a biscuit from a die cast part according to claim 14, wherein the hook includes a counterweight arm and a downwardly extending leg, said catch, together with an angled front portion, being provided at said distal end of said leg, said angled front portion slides across an edge of the biscuit thereby pivoting the hook away from the biscuit when the upper trim die moves toward the lower trim die, and the counterweight causes the hook to pivot back toward the biscuit such that the catch portion is disposed underneath the biscuit before movement of the upper trim die is reversed.

16. The method of breaking a biscuit from a die cast part according to claim 14, wherein the die cast part is formed of aluminum.

17. The method of breaking a biscuit from a die cast part according to claim 14,wherein during reverse movement of the upper trim die there is a period of lost motion in which the upper trim die remains stationary relative to the lower trim die while the hook moves upwardly relative to the upper trim die and the lower trim die.

* * * * *

UNITED STATES PATENT AND TRADEMARK OFFICE

CERTIFICATE OF CORRECTION

PATENT NO. : 6,659,160 B1
DATED : December 9, 2003
INVENTOR(S) : Dague, Jr.

It is certified that error appears in the above-identified patent and that said Letters Patent is hereby corrected as shown below:

Column 5,
Line 31, delete “A” and insert -- In a die stamping machine, a --.

Signed and Sealed this

Twenty-seventh Day of April, 2004

JON W. DUDAS
*Acting Director of the United States Patent and Trademark Office*